US008776412B2

(12) United States Patent
Areyur et al.

(10) Patent No.: US 8,776,412 B2
(45) Date of Patent: Jul. 15, 2014

(54) IRONING BOARD ASSEMBLY WITH CONFIGURABLE IRONING SURFACE AND IRONING BOARD COVER THEREFOR

(75) Inventors: Mahesh Gurumalliah Areyur, Eindhoven (NL); Seetharam Samba Subba Chigurupati, Eindhoven (NL); Quee Kiang Lee, Eindhoven (NL); Wee Ann Chong, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/810,255

(22) PCT Filed: Jul. 13, 2011

(86) PCT No.: PCT/IB2011/053128

§ 371 (c)(1),
(2), (4) Date: Jan. 15, 2013

(87) PCT Pub. No.: WO2012/011024

PCT Pub. Date: Jan. 26, 2012

(65) Prior Publication Data

US 2013/0111787 A1 May 9, 2013

(30) Foreign Application Priority Data

Jul. 23, 2010 (EP) ..... 10170581
Nov. 15, 2010 (EP) ..... 10191132

(51) Int. Cl.
*D06F 81/10* (2006.01)
*D06F 81/14* (2006.01)

(52) U.S. Cl.
USPC ..... 38/139; 38/140

(58) Field of Classification Search
USPC ..... 108/77–79
See application file for complete search history.

(56) References Cited

U.S. PATENT DOCUMENTS

| | | | | | |
|---|---|---|---|---|---|
| 1,149,467 | A * | 8/1915 | Rochau | 38/140 |
| 1,571,083 | A * | 1/1926 | Alsager | 38/140 |
| 2,659,091 | A * | 11/1953 | Boone | 4/242.1 |
| 2,729,005 | A * | 1/1956 | Foster | 38/139 |
| 2,999,325 | A | 9/1961 | Munson et al. | |
| 3,045,373 | A | 7/1962 | Olswang | |
| 3,143,086 | A * | 8/1964 | Hilldale, Jr. et al. | 108/81 |
| 3,733,724 | A * | 5/1973 | Davis | 38/140 |
| 4,910,896 | A * | 3/1990 | Ruschitzka | 38/106 |
| 6,286,237 | B1 * | 9/2001 | Toutounchian | 38/107 |
| 2003/0136035 | A1 * | 7/2003 | Lehrman | 38/140 |

FOREIGN PATENT DOCUMENTS

| | | | |
|---|---|---|---|
| WO | 2006031065 | A1 | 3/2006 |
| WO | 2010001120 | A1 | 1/2010 |

* cited by examiner

*Primary Examiner* — Ismael Izaguirre

(57) ABSTRACT

An ironing board assembly includes an ironing board having a main board portion and at least one auxiliary board portion that is movably connected to the main board portion such that the auxiliary board portion is movable between operating and collapsed positions. A flexible ironing board cover is attachable to the ironing board so as to cover ironing sides of both the main and the auxiliary board portions, and to provide an ironing surface for a user to iron on. A tensioner is configured to pull the flexible cover taut over the covered ironing sides such that the ironing surface extends seamlessly across any joint or gap between the main and auxiliary board portions.

14 Claims, 4 Drawing Sheets

IRONING BOARD ASSEMBLY WITH CONFIGURABLE IRONING SURFACE AND IRONING BOARD COVER THEREFOR

FIELD OF THE INVENTION

The present invention relates to the field of ironing board assemblies, and more in particular to an ironing board assembly having a configurable ironing surface.

BACKGROUND

A conventional ironing board assembly may typically include an elongate, substantially rectangular ironing board that is supported by two pivotally connected, foldable legs. At one end the ironing board may have a tapering tip portion, while at an opposite end an iron rest may be provided. The ironing board may comprise a metal mesh table on an ironing side of which a cushioning and heat-dissipating felt pad may be disposed. The pad may be held in place by a textile ironing board cover, an outer side of which may provide for an ironing surface.

A drawback of such a conventional ironing board assembly is that the tapering tip of the ironing board is designed to be useful for ironing a variety of garments. As a result, it is typically not suited for any garment in particular. WO 2010/001120 (Toutounchian) acknowledges this and discloses an ironing board assembly that includes an ironing board and three wing shaped attachments. A front end of the ironing board is shaped to include three adjacent, equally spaced arcs, whereas each wing shaped attachment includes an edge having an arc that is complementary to the arcs of the ironing board. Each wing shaped attachment is adapted to be detachably connectable to the ironing board at any of the three adjacent arcs so as to extend the ironing surface. Accordingly, wing shaped attachments may or may not be connected to the ironing board as desired to provide for a total of eight different ironing surface configurations.

A problem associated with an ironing board assembly according to WO'120 is that, wherever a wing shaped attachment is connected to the ironing board, a seam or gap will be present in the ironing surface at the joint of the wing and the ironing board. The seam is typically caused by the fact that the rigid frames or structures of the ironing board and the wing shaped attachment, and/or the soft flexible pads provided on the ironing sides thereof, do not seamlessly interconnect. When a garment is ironed over the seam at the joint, it will cause an undesirable crease line in the garment.

It is an object of the present invention to overcome or mitigate this problem, and to provide for an ironing board assembly with a configurable ironing surface that is smooth and without any seams or gaps.

SUMMARY OF THE INVENTION

A first aspect of the invention is directed to an ironing board assembly. The assembly comprises an ironing board that includes a main board portion, said main board portion having an ironing side, and at least one auxiliary board portion, said auxiliary board portion also having an ironing side and being movably connected to said main board portion such that it is movable between an operating position, in which the auxiliary board portion extends substantially in line or coplanar with the main board portion, and a collapsed position, in which it does not extend substantially in line or coplanar with the main board portion. The assembly further comprises a flexible ironing board cover that is attachable to the ironing board so as to cover the ironing sides of both the main board portion and the auxiliary board portion, and to provide an ironing surface for a user to iron on. The assembly also comprises tensioning means, said tensioning means being configured to pull the flexible cover taut over said covered ironing sides, such that the provided ironing surface extends seamlessly across a joint or gap between the main board portion and the auxiliary board portion, at least when the auxiliary board portion is in the operating position.

The ironing board assembly according to the present invention features an ironing board that comprises at least two board portions, namely a main board portion and at least one auxiliary board portion. The auxiliary board portion(s) may typically be smaller than the main board portion, and preferably provide for an ironing surface having an area that is smaller than a third of an ironing surface area of the main board. The position of the auxiliary board portion relative to the main board portion is adaptable to allow a user to vary the shape of the ironing board's ironing surface and/or to change, e.g. enlarge or reduce, the area thereof. The ironing surface itself is provided by an outer surface of a single-piece flexible ironing board cover that extends over the ironing sides of both or all ironing board portions. To ensure that the ironing surface presented to the user is smooth, despite possible seams or gaps between the (underlying) board portions, tensioning means are provided to pull the cover taut.

In an embodiment of the ironing board assembly, the auxiliary board portion is hingedly connected to the main board portion. The hinging connection allows a user to easily pivot the auxiliary board portion between the operating and the collapsed position. The term 'hingedly connected' is not to be construed as merely meaning 'exclusively connected by a hinge (mechanism)': a hinged connection between an main board portion and an auxiliary board portion may, next to a hinge mechanism, additionally include other linking mechanisms, such as a translation mechanism that allows for relative translating motion between the two board portions.

In another embodiment of the ironing board assembly, the auxiliary board portion, when it is in its collapsed position, is folded flat against a non-ironing side of the main board portion, preferably such that the ironing side of the main board portion and the ironing side of the auxiliary board portion face away from each other.

The connection by means of which the auxiliary board portion and the main board portion are interconnected may enable the auxiliary board portion to be collapsed or folded flat against the main board portion in order to enable compact storage of the ironing board assembly. The auxiliary board portions may preferably be foldable against a non-ironing or underside of the main board, so that the ironing side of the main board is usable irrespective of the position of the auxiliary board portion. Folding the auxiliary board portion such that its ironing side faces away from the ironing side of the main board portion may additionally facilitate the task of a tensioning mechanism to keep the ironing board cover smoothly taut over at least the ironing surface of the main board portion.

The ironing board assembly according to the present invention includes tensioning means to pull the ironing board cover taut over the ironing sides of the board portions of the ironing board. The tensioning means may take different forms in different embodiments of the ironing board assembly.

In one embodiment, the tensioning means may include an elastic fabric from which the ironing board cover is wholly or partly made. That is, the ironing board cover itself may be stretchable. Embodiments featuring an elastic, stretchable ironing board cover offer the advantage that no separate tensioning means, like the elastic members to be discussed hereafter, are required, which enhances the design and facilitates the use of the ironing board assembly. Still, an at least partly elastic ironing board cover may include an elasticated circumferential edge, a (possibly elastic) drawstring provided in a hem of the cover, or a similar means to detachably secure the cover to the ironing board. In order to allow the stretchable cover to properly accommodate to different configurations of the ironing board, without the user having to exercise considerable force in changing the configuration of the ironing board, the elastic fabric of the ironing board cover may preferably possesses two or four-way stretch, and have an elasticity that provides for an elongation of 20-30% when subject to a pull force around 500 gf (i.e. 4.90 N).

In another embodiment of the ironing board assembly according to the present invention, the tensioning means include a number of first attachment provisions, disposed along a part of a peripheral edge of the ironing board cover associated with the auxiliary board portion. They further comprise a second attachment provision, provided on a non-ironing side of the main board portion, and one or more elastic members that interconnect the first and the second attachment provisions.

To pull the ironing board cover taut over an auxiliary board portion, first attachment provisions may be provided along a peripheral edge of a part of the cover that is designed to cover said auxiliary board portion. The ironing board cover may preferably be constructed such that the first attachment provisions are located at the non-ironing side (i.e. the side facing away from the ironing side; during use typically the underside) of the auxiliary board portion when the latter is in its operating position. The first attachment provisions may be interconnected by one or more elastic members, e.g. one endless elastic string or a number of elongate/finite elastic strings, which in turn may be linked to a second attachment provision provided on a non-ironing side of the main board. When the elastic member is tightened or stretched, it draws the first attachment means towards each other (much like a drawstring), and inwards towards the main board portion, thereby pulling the cover across a circumferential edge of the auxiliary ironing board portion such that the part covering the ironing side thereof is pulled taut.

To promote approximately uniform tensioning and a symmetrical pull on the ironing cover by the elastic member, in particular to avoid bulges and the like in the ironing surface provided by the cover, the second attachment provision may preferably be disposed on a symmetry line of the auxiliary board portion. The auxiliary board portion may, for example, possess line-symmetry relative to a symmetry line that extends substantially perpendicular to an axis around which the auxiliary board portion is hingeable relative to the main board portion, and the second attachment provision may be provided substantially on that symmetry line (centering the pull force with respect to the shape of the auxiliary board portion). In addition, the first attachment provisions may preferably be substantially equidistantly spaced along the peripheral edge of the ironing board cover to distribute the pulling force evenly.

In another embodiment of the ironing board assembly, the assembly comprises a bolt mechanism configured to releasably lock the auxiliary board portion in its operating position and/or its collapsed position.

A bolt mechanism may be provided to releasably lock an auxiliary board portion in its operating or collapsed position. Such a bolt mechanism may for example include a slidable bolt, a guide for guiding the slidable bolt and a keeper or a bearing surface. The guide may preferably be connected to a back side or underside of one of the main board portion and the auxiliary board portion, while the keeper or bearing surface may be disposed on the back side of the other. The arrangement may be such that the bolt is movable within the guide, and slidable into the keeper or against the bearing surface when the auxiliary board portion is in its operating/collapsible position, so as to lock the respective mutual arrangement of the main board portion and the auxiliary board portion.

Generally, an ironing board may be arbitrarily divided in a main board portion and one or more auxiliary board portions, each board portion having a desired shape and size, and the main board portion typically being the largest of them. Certain ironing board configurations, however, seem particularly useful.

In one embodiment of the ironing board assembly, for example, an auxiliary board portion may be movably connected at an end or transverse edge of a substantially elongate main board portion, so as to provide the latter with a collapsible tip. The tip may preferably have an outwardly tapering profile to facilitate insertion into narrow garment parts.

In another embodiment of the ironing board assembly, the ironing board may comprise two auxiliary board portions that are movably connected to the main board portion at opposite longitudinal edges thereof, so as to provide the main board portion with a pair of collapsible winglets. The winglets may preferably be provided adjacent a free end of the main board portion, such that the ironing board at said end may assume a shoulder yoke shape when the winglets are moved into their operating positions, facilitating the ironing of the back shoulder portions of shirts and the like.

In yet another embodiment of the ironing board assembly that is particularly suited for compact storage, the central elongate board portion that would typically constitute the main board portion of the ironing board may itself be divided into a main board portion and an auxiliary board portion. The embodiment thus features an ironing board comprising two approximately equally sized board portions that together provide for most or all of the surface area of the ironing board. In such a case, an ironing surface area associated with the main board portion and an ironing surface area associated with the auxiliary board portion may preferably differ in size by no more than 50% of the smallest one of said areas.

Another aspect of the present invention is directed to an ironing board cover for use with the ironing board assembly according to the present invention. The ironing board cover comprises a main cover portion that is configured to cover an ironing side of a substantially elongate main board portion of an ironing board, and at least one auxiliary cover portion that is seamlessly attached to the main cover portion and configured to cover an ironing side of at least one auxiliary board portion of the ironing board, which auxiliary board portion protrudes from the main board portion at or adjacent a (longitudinal) end thereof. In one embodiment the ironing board cover includes two auxiliary cover portions arranged to cover the respective ironing sides of two auxiliary board portions that protrude from opposite longitudinal edges of the main board portion adjacent the end thereof. In another embodiment, the ironing board cover may also include an auxiliary cover portion arranged to cover the ironing side of an auxiliary board portion that longitudinally protrudes from an end of the elongate main board portion.

Known ironing board covers for known ironing board assemblies are typically designed to fit a non-reconfigurable ironing board with a smooth circumferential edge that may include straight and slightly convexly shaped edge portions (having relatively large radii of curvature). Hence these covers are not fit for covering ironing boards including ironing board extensions that irregularly protrude from the main board portion, and that may be rearranged between an operating position and a collapsed position. Instead, such ironing board extensions or attachments, as known from for example WO'120, typically come provided with their own cover. As discussed, the use of extensions may give rise to seams in the overall ironing surface and result in creases in garments ironed over them. The present invention overcomes this problem by providing for a seamless ironing board cover configured to cover both a main board and any auxiliary board portions protruding therefrom. When such a cover is pulled taut, no seams remain in the ironing surface it provides. The ironing board cover may be fitted with incorporated tensioning means to pull it taut, for example by manufacturing it at least partly from an elastic material possessing two- or four-way stretch, and having an elasticity that provides, for instance, for an elongation of 20-30% (test length of 100 mm) when subject to a pull force of 4.90 N. Alternatively, the ironing board cover may—in use—be pulled taut by separate tensioning means (cf. the elastic members described infra). To detachably secure the cover to a reconfigurable ironing board, the cover may include an at least partly elasticated circumferential edge, or a (possibly elastic) drawstring provided in a hem of the cover. Alternatively, or in addition, the ironing board cover may include a number of first attachment provisions, disposed along a part of a circumferential edge of the ironing board cover, in particular a part associated with the at least one auxiliary board portion, wherein the attachment provisions are configured to be connected to second attachment provisions provided on an ironing board. The connections between the first and second attachment provisions may be direct, or by means of one or more elastic members that may at the same time provide for at least a part of a pulling force to pull the cover taut.

These and other features and advantages of the invention will be more fully understood from the following detailed description of certain embodiments of the invention, taken together with the accompanying drawings, which are meant to illustrate and not to limit the invention.

DETAILED DESCRIPTION

Figure 1:
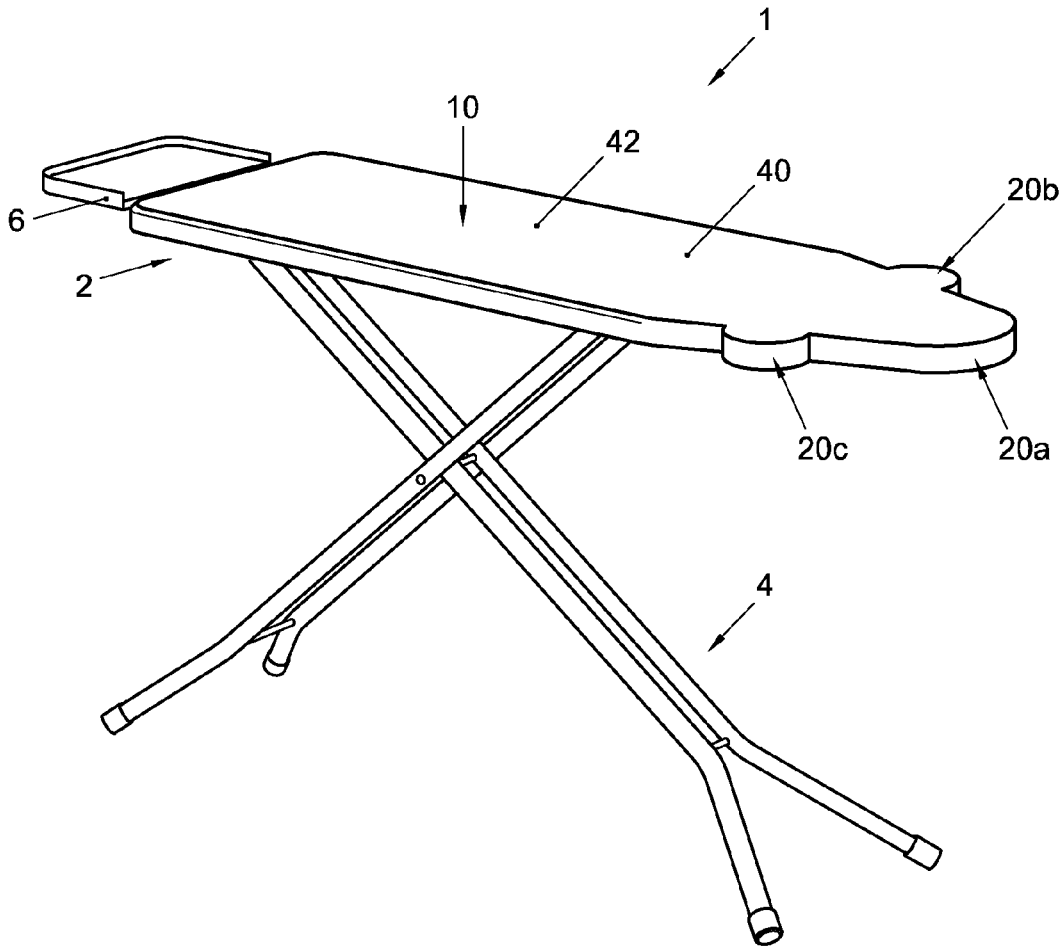
FIG. 1 is a schematic perspective view of an exemplary ironing board assembly according to the present invention, having a configurable ironing surface.

FIG. 1 is a schematic perspective view of an exemplary ironing board assembly 1 according to the present invention. A schematic top view of the ironing board assembly 1 is shown in FIG. 2.

Figure 2:
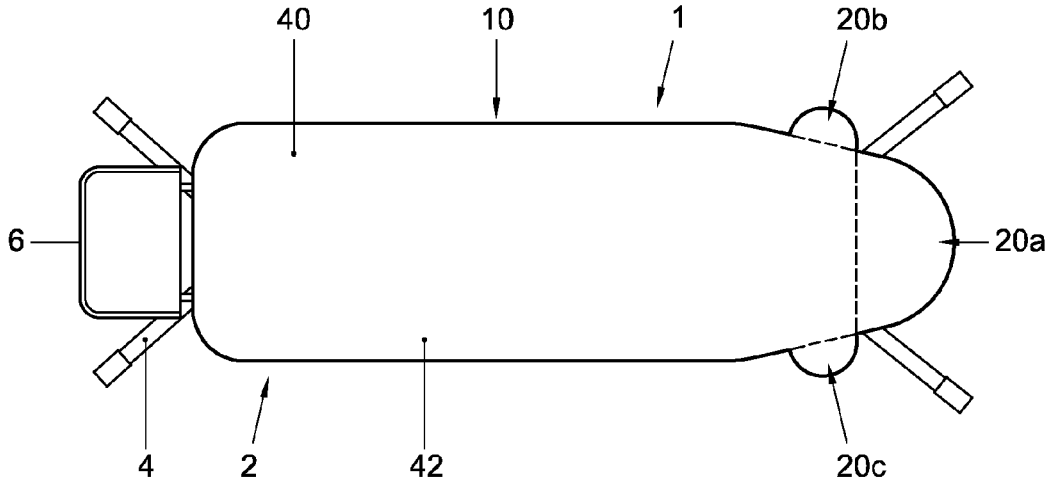
FIG. 2 is a schematic top view of the ironing board assembly shown in FIG. 1.

Referring now in particular to FIGS. 1 and 2. The ironing board assembly 1 comprises an ironing board 2 that is supported by an in itself conventional foldable leg assembly 4 attached to an underside of the ironing board 2. At one end of the substantially elongate ironing board 2 an iron rest 6 may be provided.

The ironing board 2 comprises a main board portion 10 and three auxiliary board portions 20*a-c* that are moveably connected thereto. In the embodiment of FIGS. 1 and 2, each of the auxiliary board portions 20*a-c* is hingedly connected to the main board portion 10 by one or more single-degree-of-freedom hinges 22*a-c* (invisible in FIG. 1; cf. FIG. 4-6). The hinges 22*a-c* allow the respective auxiliary board portions 20*a-c* to be hinged between an operating position, as shown in FIG. 1, and a collapsed position in which they are folded flat against the underside of the main board portion 10 (cf. FIG. 5). The axes around which the auxiliary board portions 22*a-c* are pivotable are schematically illustrated in the top view of FIG. 2 by means of dashed lines.

Auxiliary board portion 20*a*, provided at an end of the elongate main board portion 10, serves as a foldable tip of the ironing board 2. The auxiliary board portions 20*b*, 20*c*, which are provided at opposite longitudinal edges/sides of the main board portion 10 and near the free end (distal to the iron rest 6) thereof, provide the main board portion 10 with a pair of foldable shoulder-shaped winglets which together form a shoulder yoke configuration. Although the auxiliary board portions 20*a-c* may in principle take any desired shape, they may preferably have a smooth peripheral edge and a tapering or convex profile, so as to facilitate insertion into possibly narrow garment portions.

Figure 4:
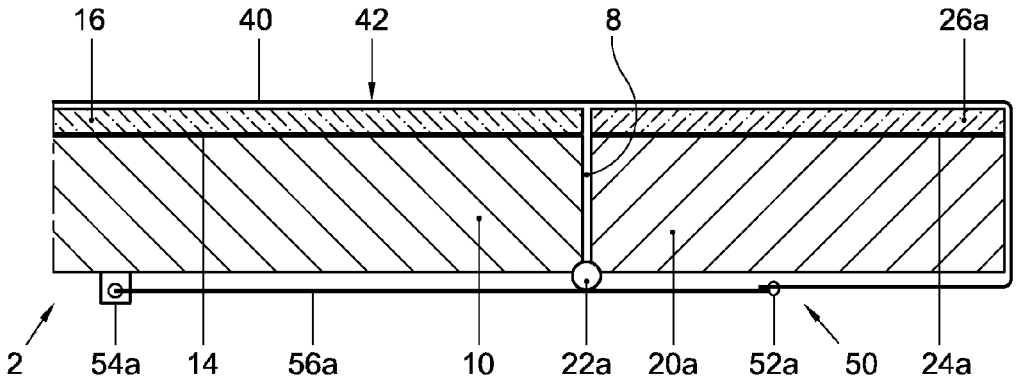
FIG. 4 is a schematic cross-sectional side view of the ironing board of the ironing board assembly shown in FIG. 1, illustrating a main board portion and an auxiliary board portion, wherein the auxiliary board portion is in an operating position.

As better visible in FIG. 4, each board portion 10, 20*a-c* of the ironing board 2 has an ironing side 14, 24*a-c* on which ironing may take place. When a board portion 10, 20*a-c* is being used for ironing, the ironing sides 14, 24*a-c* normally correspond to the upper or upward facing side of the board portion. A cushioning and heat-dissipating layer 16, 26*a-c*, e.g. a felt layer, may be provided on the ironing sides 14, 24*a-c* of the board portions 10, 20*a-c*, which layers may in turn be held in place or at least be covered by an ironing board cover 40.

The ironing board cover 40 is a flexible, single-piece item that simultaneously and at least partly covers all ironing sides 14, 24*a-c* of the main board portion 10 and the auxiliary board portions 20*a-c*, irrespective of the configuration of the ironing board 2. That is to say, there is only one ironing board cover 40 for the entire ironing board 2, despite the fact that the ironing board 2 comprises different board portions 10, 20*a-c* that can be arranged independently to form an ironing board 2 having a desired shape. The ironing board cover 40 may be made from any suitable material, such as for example cotton. In some embodiments the cover material may be elastic, but this need not be the case.

In embodiments that feature an ironing board cover 40 that is wholly or partly made from an elastic, stretchable fabric the following material specifications may serve as guidance. The fabric may preferably possess two- or four-way stretch, so as to allow it to stretch in both a length and a width direction. In addition, the elasticity of the fabric may preferably be such that it provides for an elongation of 20-30% when subject to a pull force of 500 gf (i.e. 4.90 N). One advantageous exemplary fabric complying with these specifications is cotton-elastane, including 97-95% cotton and 3-5% spandex/lycra. However, alternative fabric materials (e.g. cotton with silicone treatment, Aramid, etc.) and weaves (braided, woven, knitted, etc.) may be employed as well. The fabric may preferably be able to withstand exposure to heat at typical sole-plate temperatures without suffering damage, such as scorch marks. For short periods of time up to ten seconds the fabric may preferably be able to withstand temperatures up to about 230° C., while for longer periods up to about two hours, it may preferably be heat resistant for temperatures up to 180° C. The fabric may optionally be supplied with a flame retardant, e.g. metallic type, coating, or be impregnated with such a retardant. As part of its manufacturing process, the fabric of the ironing board cover 40 may further be subject to a pre-shrinkage treatment to avoid shrinkage of board cover during later use/repeated wash.

When an auxiliary board portion 20*a-c* is in its operating position, it extends in line or coplanar with the main ironing board portion 10, as shown in FIGS. 1, 2 and 4. In FIG. 1 all auxiliary board portions 20*a-c* are in their operating positions. Where the ironing board cover 40 extends over the ironing sides 14, 24*a-c* of an ironing board portion 10, 20*a-c* in a non-collapsed, operative position, its outward facing surface presents itself to the user as an ironing surface 42. For proper ironing results, it is important that this ironing surface 42 is free of creases. The single-piece nature of the ironing board cover 40 enables such a crease free ironing surface 42, provided that a tensioning system is provided for pulling the cover 40 taut, in particular across any joints or gaps 8 (cf. FIG. 4) between the main ironing board 10 and the auxiliary ironing boards 20*a-c*.

Figure 3:
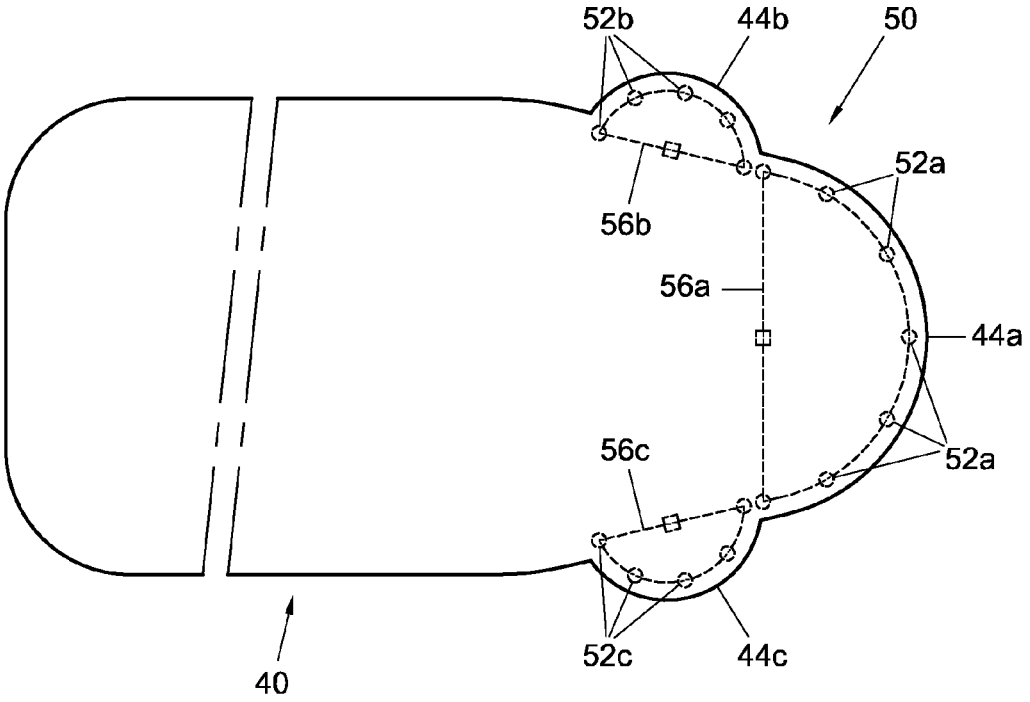
FIG. 3 is a schematic top view of a spread out ironing board cover that forms part of the ironing board assembly shown in FIG. 1.
Figure 5:
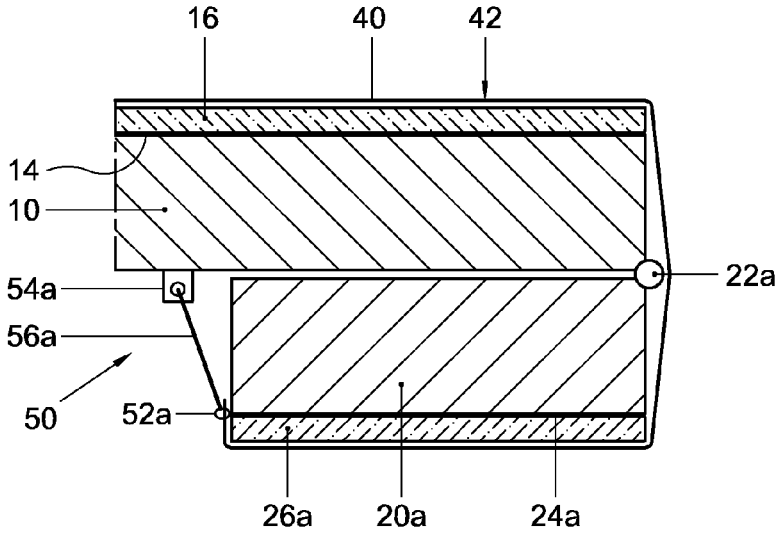
FIG. 5 is a schematic cross-sectional side view of the ironing board of the ironing board assembly shown in FIG. 1, illustrating a main board portion and an auxiliary board portion, wherein the auxiliary board portion is in a collapsed position.

Exemplary tensioning means 50 and their operation will now be illustrated with reference to in particular FIGS. 3, 4 and 5. FIG. 3 is a schematic top view of a spread out iron board cover 40 that forms part of the ironing board assembly shown in FIG. 1. FIG. 4 is a schematic cross-sectional side view of the ironing board 2 as shown in FIG. 1, illustrating both the main board portion 10 and the auxiliary board portion 20*a* in its operating position. FIG. 5 is a cross-sectional side view similar to that of FIG. 4, but now with the auxiliary board portion 20*a* in its collapsed position.

The tensioning means 50 in the depicted embodiment include, for each auxiliary board portion 20*a-c*, a number of first attachment provisions 52*a-c*, such as eyelets. The first attachments provisions 52-*ac* are disposed along a part 44*a-c* of a peripheral edge of the ironing board cover 40 that is associated with a respective board portion. This is shown in FIG. 3. For reasons of symmetry and uniform force application the first attachment provisions 52*a-c* may be spaced apart substantially equidistantly along the respective parts 44*a-c* of the peripheral edge.

The tensioning means 50 may further comprise, for each auxiliary board portion 20*a-c*, a second attachment provision 54*a-c*. Each such second attachment provision 54*a-c*, which may for example take the form of a hook or an eyelet, may be disposed at an underside of the main board portion 10, as shown in FIGS. 4 and 5.

Furthermore, the tensioning means 50 may include, for each auxiliary board portion 20*a-c*, an elastic member 56*a-c* that interconnects the first 52*a-c* and the second 54*a-c* attachment provisions associated with a respective auxiliary board portion 20*a-c*. In one embodiment, the elastic member 56*a-c* may be an elastic string that serially interconnects or interlaces all first attachment provisions 52*a-c* associated with a respective auxiliary board portion 20*a-c*, i.e. connects them in the order in which they are disposed along said part 44*a-c* of the peripheral edge. See FIG. 3. Each elastic member may also connect to the second attachment provision 54*a-c*. This second attachment provision 54*a-c* may then serve as a fixed anchor point, whereas the first attachment provisions 52*a-c* may be movable along the elastic member and relative to each other. The approximate location of a point of an elastic member 56*a-c* that may be connected to the second attachment provision 54*a-c* is marked with a little square in FIG. 3.

The working of the tensioning means 50 may be described as follows. When an auxiliary board portion, e.g. board portion 20*a* in FIGS. 4 and 5, is in its operating position, it extends in line with the main board portion 10. However, due to the configurability of the ironing board 2, and more in particular the foldability of auxiliary board portion 20*a*, a joint or gap 8 may exist between the main board portion 10 and the auxiliary board portion 20*a*. Ironing a garment over such a gap 8 may result in a crease. To prevent this, the cover 40, which extends over the entire ironing board 2, is pulled taut by the tensioning means 50. To optimally smooth the ironing surface 42 provided by the cover 40, the pulling force is substantially uniformly applied to the part 44*a* of the peripheral edge of the ironing board cover 40 associated with the auxiliary board portion 20*a* through the elastic member 56*a* that interconnects the first attachment provisions 52*a* provided along said part. The second attachment provision 54*a*, provided at the underside of the main board portion 10, provides for an anchor point that allows the elastic member to pull back or inwards on the cover 40, i.e. in a direction away from the outer circumferential edge of the auxiliary board portion 10.

From the operating position shown in FIG. 4, the auxiliary board portion 20*a* may be pivoted into the collapsed position of FIG. 5. In this latter position, the auxiliary board portion 20*a* abuts the underside of the main board portion 10, such that its ironing side 24*a* faces away from the ironing side 14 of the main board portion.

As may be inferred from FIGS. 4 and 5, the elastic member 56*a* may first lengthen and subsequently shorten during collapse of the auxiliary board portion 20*a*. The lengthening may occur without causing excessive tensioning of the board cover 40. When the auxiliary board portion 20*a* is in its collapsed position (FIG. 5), the length of the elastic member 56*a* is shorter than when the auxiliary board portion 20*a* is in its operating position (FIG. 4). Even in the collapsed position, however, the elastic member 56*a* exerts a force on the cover 40 to keep it taut and in place. As no gaps have to be bridged beneath the ironing surface 42, the smaller force is not an issue.

Figure 6:
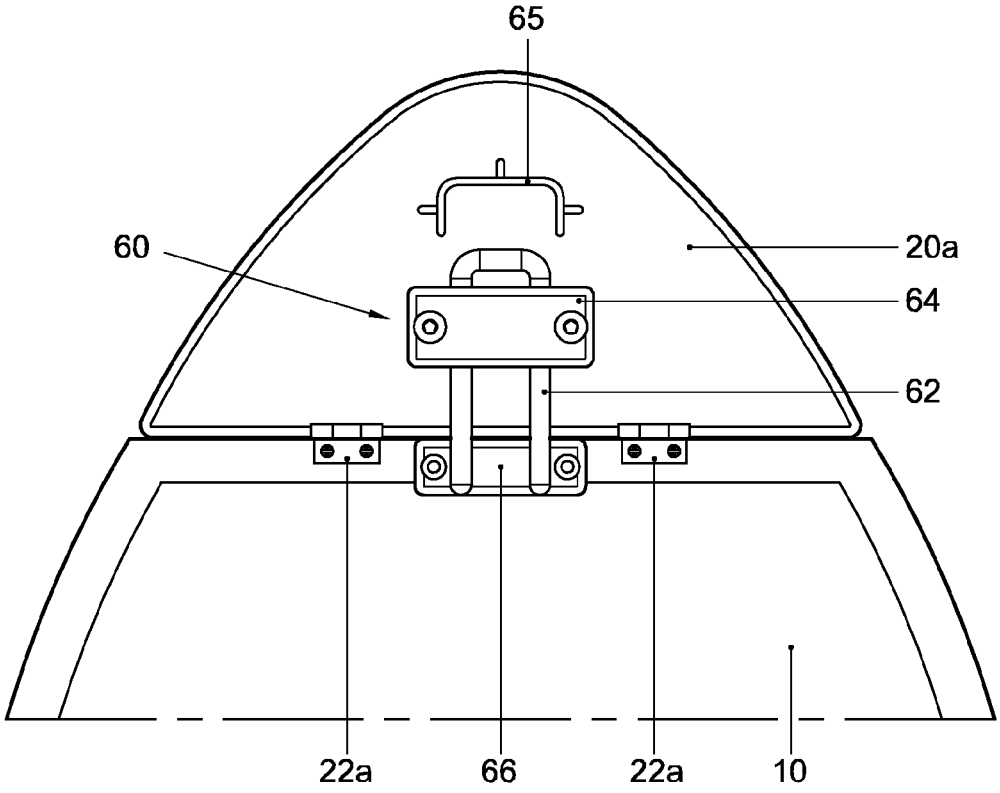
FIG. 6 is a schematic bottom view of an exemplary bolt mechanism configured to releasably lock an auxiliary board portion of the ironing board shown in FIG. 1 in its operating position.

FIG. 6 is a schematic bottom view of an exemplary bolt mechanism 60 that may be used with the ironing board assembly 1 of the present invention to lock an arbitrary auxiliary board portion 20*a-c*, such as the foldable tip 20*a* of the ironing board 2, in its operating position. The bolt mechanism 60, which is entirely provided at an underside of the ironing board 2, includes a slidable bolt 62, a guide 64 for guiding the sliding movement of the bolt 62 and a bearing surface 66. The guide 64 is disposed at an underside of the auxiliary board portion 20*a*. It is configured to guide and limit the inward movement of the U-shaped bolt 62 and supplemented with a slide-stop 65 that additionally limits the outward movement thereof. The bearing surface 66 is provided at the underside of the main board portion 10.

When the auxiliary board portion 20*a* is in its operating position the U-shaped bolt 62 may be slid inwards, such that its two extremities extend across the joint between the auxiliary 20*a* and the main 10 board portion and come to bear against the bearing surface 65. See FIG. 6. In this state, the auxiliary board portion 20*a* is locked in position and capable of carrying a load. By retracting the bolt 62 outwards the auxiliary board portion 20*a* can be released from its locked position, allowing it to be folded inwards against the underside of the main board portion (cf. FIG. 5).

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, it is noted that particular features, structures, or characteristics of one or more embodiments may be combined in any suitable manner to form new, not explicitly described embodiments.

LIST OF ELEMENTS

1 Ironing board assembly
2 Ironing board
4 Foldable leg assembly
6 Iron rest
8 Gap between main board portion and auxiliary board portion
10 Main board portion
14 Ironing side of main board portion
16 Felt layer provided on ironing side of main board portion
20 Auxiliary board portion
22 Hinge connecting auxiliary board portion to main board portion
24 Ironing side of auxiliary board portion
26 Felt layer provided on ironing side of auxiliary board portion
40 Ironing board cover
42 Ironing surface
44 Part of peripheral edge of ironing board cover associated with an auxiliary board portion
50 Tensioning means
52 First attachment provision
54 Second attachment provision
56 Elastic member
60 Bolt mechanism
62 Slidable bolt
64 Guide for slidable bolt
65 Slide stop
66 Bearing surface
a,b,c . . . A suffix a, b, c . . . denotes an association with auxiliary board portion 20*a*, 20*b*, 20*c* . . . respectively.

The invention claimed is:

1. An ironing board assembly, comprising:
an ironing board, including:
a main board portion having a main ironing side, and
at least two auxiliary board having portions each having an auxiliary ironing side and being movably connected to said main board portion such that the at least two auxiliary board portions are movable between an operating position, in which the at least two auxiliary board portions extend substantially coplanar with the main board portion, and a collapsed position, in which the at least two auxiliary board portion not extend substantially in line with the main board portion, wherein the at least two auxiliary board portions are moveable independently of each other;
a flexible cover attachable to the ironing board so as to cover the main and auxiliary ironing sides to provide an ironing surface for a user to iron on; and
a first tensioner and a second tensioner configured to independently pull the flexible cover taut over said covered main and auxiliary ironing sides, such that the ironing surface extends seamlessly across any joint or gap between the main board portion and the at least two auxiliary board portions, at least when the at least two auxiliary board portions are in the operating position,
wherein the first tensioner and the second tensioner are configured to independently act on a first auxiliary board portion and a second auxiliary board portion of the at least two auxiliary board portions.

2. The ironing board assembly according to claim 1, wherein the at least two auxiliary board portions are hingedly connected to the main board portion.

3. The ironing board assembly according to claim 1, wherein the at least two auxiliary board portions, when in the collapsed position, are folded flat against the non-ironing side of the main board portion, such that the main ironing side and the auxiliary ironing sides face away from each other.

4. An ironing board assembly, comprising:
an ironing board, including:
a main board portion having a main ironing side, and
at least one auxiliary board portion having an auxiliary ironing side and being movably connected to said main board portion such that at least one auxiliary board portion is movable between an operating position, in which the at least one auxiliary board portion extends substantially coplanar with the main board portion, and a collapsed position, in which the at least one auxiliary board portion does not extend substantially coplanar with the main board portion;
a flexible cover attachable to the ironing board so as to cover the main ironing side and the auxiliary ironing side to provide an ironing surface for a user to iron on; and
tensioning means configured to pull the flexible cover taut over said covered main and auxiliary ironing sides such that the ironing surface extends seamlessly across any joint or gap between the main board portion and the at least one auxiliary board portion, at least when the at least one auxiliary board portion is in the operating position,
wherein the tensioning means include an elastic fabric of which the ironing board cover is at least partly made, and
wherein the elastic fabric of the ironing board cover possesses two- or four-way stretch, and has an elasticity that provides for an elongation of 20-30% when subject to a pull force of 4.90 N.

5. The ironing board assembly according to claim 1, wherein each of the first tensioner and the second tensioner includes:
a plurality of first attachment provisions disposed along a part of a peripheral edge of the flexible cover associated with the auxiliary board portion;
a second attachment provision provided on a non-ironing side of the main board portion; and
an exposed elastic member that successively connects successive ones of the plurality of first attachment provisions to the second attachment provision for forming a continuous loop.

6. The ironing board assembly according to claim 5, wherein the second attachment provision is disposed on a symmetry line of the at least two auxiliary board portions.

7. The ironing board assembly according to claim 5, wherein the plurality of first attachment provisions is substantially equidistantly spaced along said part of said peripheral edge of the ironing board cover.

8. The ironing board assembly according to claim 1, further comprising a bolt mechanism configured to releasably lock the at least two auxiliary board portions in at least one of the operating and the collapsed position.

9. The ironing board assembly according to claim 1, wherein one of the at least two auxiliary board portions is movably connected at an end of the main board portion to provide the main board with a collapsible tip.

10. The ironing board assembly according to claim 1, wherein the at least two auxiliary board portions are movably connected to the main board portion at opposite longitudinal edges of the main board portion to provide the main board portion with a pair of collapsible winglets.

11. The ironing board assembly according to claim 1, wherein an ironing surface area associated with the at least two auxiliary board portions is smaller than one third of an ironing surface area associated with the main board portion.

12. An ironing board cover comprising:

an elastic fabric;

a main cover portion configured to cover an ironing side of a substantially elongate main board portion of an ironing board; and at least two auxiliary cover portions seamlessly attached to the main cover portion and configured to cover an ironing side of the at least two auxiliary board portions, wherein the at least two auxiliary board portions protrude from the main board portion at or adjacent an end of the main board portion, wherein the at least two auxiliary cover portions are each configured to include a plurality of first attachment provisions disposed along a part of a peripheral edge of the at least two auxiliary cover portions; and wherein the plurality of first attachment provisions is configured to allow continuous movement of a respective exposed elastic member independent of each other through the plurality of first attachment provisions of each of the at least two auxiliary cover portions.

13. The ironing board cover according to claim 12, comprising two auxiliary cover portions arranged to cover the respective ironing sides of two auxiliary board portions that protrude from opposite longitudinal edges of the main board portion adjacent the end thereof.

14. An ironing board cover comprising:

a main cover portion configured to cover an ironing side of a main board portion of an ironing board; and at least one auxiliary cover portion seamlessly attached to the main cover portion and configured to cover an ironing side of at least one auxiliary board portion of the ironing board, wherein the auxiliary board portion protrudes from the main board portion at or adjacent an end of the main board portion, wherein the ironing board cover is at least partly made of an elastic fabric, and wherein the elastic fabric possesses two- or four-way stretch, and having an elasticity that provides for an elongation of 20-30% when subject to a pull force of 4.90 N.

* * * * *